US007789204B2

(12) United States Patent
Amano

(10) Patent No.: US 7,789,204 B2
(45) Date of Patent: Sep. 7, 2010

(54) REMOTE INFORMING SYSTEM FOR ELEVATOR

(75) Inventor: Masaaki Amano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 545 days.

(21) Appl. No.: 11/816,018

(22) PCT Filed: Jan. 24, 2006

(86) PCT No.: PCT/JP2006/301005

§ 371 (c)(1),
(2), (4) Date: Aug. 10, 2007

(87) PCT Pub. No.: WO2007/086098

PCT Pub. Date: Aug. 2, 2007

(65) Prior Publication Data

US 2009/0071762 A1 Mar. 19, 2009

(51) Int. Cl.
*B66B 1/34* (2006.01)

(52) U.S. Cl. ..... 187/393; 187/247

(58) Field of Classification Search ..... 187/247, 187/248, 391–396, 313
See application file for complete search history.

(56) References Cited

U.S. PATENT DOCUMENTS

| | | | | |
|---|---|---|---|---|
| 3,973,648 | A * | 8/1976 | Hummert et al. | 187/393 |
| 4,418,795 | A * | 12/1983 | Trosky et al. | 187/391 |
| 4,697,243 | A * | 9/1987 | Moore et al. | 706/59 |
| 4,930,604 | A * | 6/1990 | Schienda et al. | 187/393 |
| 5,557,546 | A * | 9/1996 | Fukai et al. | 702/185 |
| 5,736,694 | A * | 4/1998 | Ketoviita | 187/391 |
| 6,330,935 | B1 * | 12/2001 | Systermans | 187/391 |
| 7,162,233 | B2 * | 1/2007 | Chiba | 455/420 |
| 7,172,055 | B2 * | 2/2007 | Engel et al. | 187/391 |
| 7,377,364 | B2 * | 5/2008 | Tyni et al. | 187/380 |

FOREIGN PATENT DOCUMENTS

| | | |
|---|---|---|
| JP | 3 293275 | 12/1991 |
| JP | 7 69548 | 3/1995 |
| JP | 2001 101557 | 4/2001 |
| JP | 2002 255465 | 9/2002 |
| JP | 2003 104644 | 4/2003 |
| JP | 2004 110117 | 4/2004 |
| JP | 2005 162435 | 6/2005 |
| JP | 2005 206309 | 8/2005 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

A remote alarming system for an elevator includes: an elevator control device; a wireless alarming device provided independently of the elevator control device, for transmitting failure information of an elevator from the elevator control device through wireless communication; a management device remotely provided from a building in which the elevator is installed, and which performs wireless communication; and a portable terminal which performs the wireless communication with the wireless alarming device and the management device via a base station. The management device includes a database in which management information corresponding to each of the elevators is registered in advance, determines an alarm destination based on the management information registered in the database at a time of reception of the failure information, creates a telegraphic message to be transmitted based on contents of the failure information, and transmits the created telegraphic message to the portable terminal which is the determined alarm destination. The wireless alarming device allows the communication from the portable terminal as the alarm destination to a passenger in a car by connecting with a speaker provided in the car of the elevator.

2 Claims, 3 Drawing Sheets

FIG. 2

| NUMBER | ADDRESS | BUILDING NAME | CAR NUMBER | WIRELESS ALARMING DEVICE CONTACT ADDRESS | BUILDING MANAGER CONTACT ADDRESS | MAINTENANCE OPERATOR CONTACT ADDRESS |
|---|---|---|---|---|---|---|
| 1391378 | xxxxxxxxxxxxxx | xxxxx Tower | No.1 | xxxxxxxxxxx | xxxxxxxxxxx | xxxxxxxxxxxxx |
| | | | | | | |
| | | | | | | |

FIG. 3

---

<<Failure Information>>

No.1391378

2005-09-14 01:35:05 xxxxx Tower No.1

Emergency stop.

---

REMOTE INFORMING SYSTEM FOR ELEVATOR

TECHNICAL FIELD

The present invention relates to a remote alarming system for an elevator.

BACKGROUND ART

Conventionally, a remote monitoring control system has been realized and placed in operation. In the remote monitoring control system, states and failure information of elevating machines such as an elevator and an escalator installed in a specific area are collectively monitored, and if necessary, control is performed on the elevating machine by connecting the elevating machine to a centralized monitor center installed in a remote area through a general public line. Further, in recent years, along with increases in speed and capacity of the general public line, a high-speed digital network for realizing the Internet or the like is being developed more widely in addition to an analog line conventionally used, by using an existing telephone line, whereby it is possible to transmit image information and sound information in real time at high speed.

On the other hand, there has been a particular demand that, if a failure should occur in the elevator and if a passenger should be trapped in a car thereof, an alarm be given to an operation manager of the elevator or a maintenance company for the elevator immediately, the passenger trapped in the car be rescued, and the elevator be speedily restored to its normal state.

Conventionally, various propositions have been made for the remote alarming system described above. For example, there is proposed a system in which abnormality information and pre-failure information are transmitted to a portable terminal of a maintenance operator through the Internet in a case where an abnormality occurs (see, for example, Patent Document 1). There is also proposed a system in which a failure history is stored in advance in the monitor center and the failure history is transmitted to the portable terminal of the maintenance operator in a case where failure occurs (see, for example, Patent Document 2). Further, there is proposed a system in which a positional relationship of a target area centering on a building in which the failure has occurred with a primary responder and a secondary responder is displayed on a monitor of the monitor center, and a dispatch instruction is automatically transmitted to portable phones of the primary responder and the secondary responder in a case of a significant failure (see, for example, Patent Document 3).

Patent Document 1: JP 2001-101557 A

Patent Document 2: JP 2003-104644 A

Patent Document 3: JP 2004-110117 A

DISCLOSURE OF THE INVENTION

Problem to be Solved by the Invention

However, with the conventional systems, a large-scaled and a high-cost monitor center is required to be provided in any of the cases, which results in a tremendous cost for initial capital investment and system development. Further, an operator must be present on the monitor center side for outputting the instruction in any of the cases, which results in generation of a labor cost or the like for an operation. Further, there is no description on information transmitting means for the passenger at the time of failure, so in a case where the building manager is absent and the monitor center fails down, no contact can be made from the outside to the passenger trapped in the elevator until the maintenance operator arrives.

The present invention has been made in view of the above-mentioned circumstances and therefore has an object to provide a remote alarming system for an elevator in which a remote alarming system can be built with a relatively simple structure and an abnormality can be handled promptly in the case where abnormality occurs, without a provision of a large-scaled and high-cost monitor center.

Means for Solving the Problems

According to the present invention, a remote alarming system for an elevator includes: an elevator control device including failure information detecting means for detecting failure information of an elevator; a wireless alarming device provided independently of the elevator control device, for transmitting the failure information of the elevator from the elevator control device through wireless communication; a management device remotely provided from a building in which the elevator is located, and which is capable of performing wireless communication; and a portable terminal which is capable of performing the wireless communication with the wireless alarming device and the management device via a base station. In the remote alarming system, the management device includes: a database in which management information corresponding to each of the elevators is registered in advance; communication information creating means for determining an alarm destination based on the management information registered in the database at a time of reception of the failure information, and for creating a telegraphic message transmitted based on contents of the failure information; and wireless communication means for transmitting the created telegraphic message to the portable terminal which is the determined alarm destination, and the wireless alarming device includes in-car communication means which makes possible the communication from the portable terminal as the alarm destination to a passenger in a car by connecting with a speaker provided in the car of the elevator.

EFFECTS OF THE INVENTION

According to the present invention, the remote alarming system can be built with a relatively simple structure, and an abnormality can be handled promptly in the case where abnormality occurs. In addition, direct communication is possible between the portable terminal and the passenger in the car, so even when the manager of the building is absent or the monitoring device fails, communication can be directly performed with the passenger in the car.

BRIEF DESCRIPTION OF THE DRAWINGS

FIG. 2 is a diagram for explaining management information registered in a database 42 in a management device 4 of FIG. 1.

FIG. 3 is a diagram showing an example of a telegraphic message transmitted to a portable terminal 5 of FIG. 1.

BEST MODE FOR CARRYING OUT THE INVENTION

Hereinafter, an embodiment of the present invention will be described with reference to the drawings.

Figure 1:
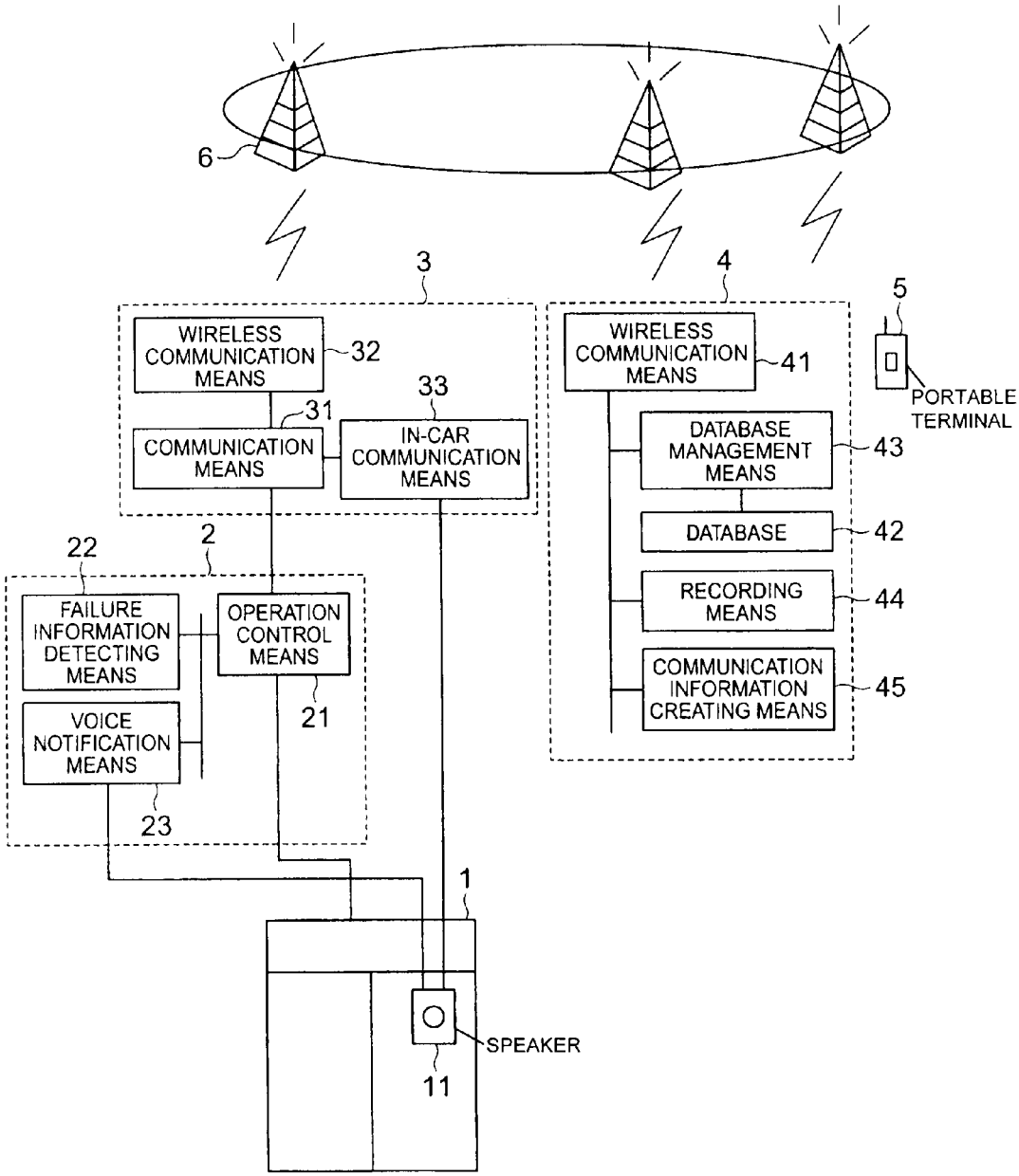
FIG. 1 is a block diagram showing a configuration of a remote alarming system for an elevator according to an embodiment of the present invention.

FIG. 1 is a block diagram showing a configuration of a remote alarming system for an elevator according to the embodiment of the present invention. The remote alarming system for an elevator shown in FIG. 1 includes: a speaker 11 provided in a car 1 of an elevator, which is used for an announcement by voice or for communication with the outside; an elevator control device 2; a wireless alarming device 3 provided independently of the elevator control device 2; a management device 4 composed of a computer having a relatively simple structure, which is remotely provided from a building in which the elevator is installed and which is capable of performing wireless communication; a portable terminal 5 held by a manager of the building or a maintenance operator of the elevator, which is capable of performing wireless communication with the wireless alarming device 3 and the management device 4 via a base station 6; and the base station 6.

Here, the elevator control device 2 includes operation control means 21 for performing operation management of the whole elevator, failure information detecting means 22 for detecting a failure of the elevator, and voice notification means 23 for notifying a message by voice in the car depending on an operation state of the elevator, and for notifying by voice through the speaker a fact that an alarm has been transmitted to the outside at a time of transmitting failure information to be described later.

Further, the wireless alarming device 3 includes communication means 31 for communicating with the elevator control device 2, wireless communication means 32 for performing wireless communication with the outside, and in-car communication means 33 for communicating with the outside by connecting to the speaker 11 in the car 1.

Further, the management device 4 includes wireless communication means 41 for enabling communication with the outside via radio transmission, a database 42 in which management information necessary for transmitting the failure information is registered in advance, database management means 43 for managing the database 42, recording means 44 for storing communication records, and communication information creating means 45 for creating a telegraphic message transmitted in accordance with the generated failure information.

FIG. 2 is a diagram for explaining management information registered in advance in the database 42 in the management device 4. As shown in FIG. 2, pieces of information including an indigenous number of each of the elevators, an address of the building in which the elevator is installed, a name of the building, a car number, a wireless alarming device contact address, a contact address of the manager of the building, and a contact address of a maintenance operator are stored in the database 42. These pieces of data are defined for each of the elevators to be managed.

Next, FIG. 3 is a diagram showing an example of a telegraphic message to be transmitted to the portable terminal 5 held by the manager of the building or the maintenance operator. In the example shown in FIG. 3, which is an example of a screen of the portable terminal 5, when a failure occurs, pieces of information including "No. 1391378" as the indigenous number of the elevator, "2005-09-14 01:35:05" as date/time of failure occurrence, "XXXXX Tower No. 1" as the name of the building, "Emergency stop" as a content of the failure, and the like are transmitted as "Failure Information" and displayed on a screen.

Figure 4:
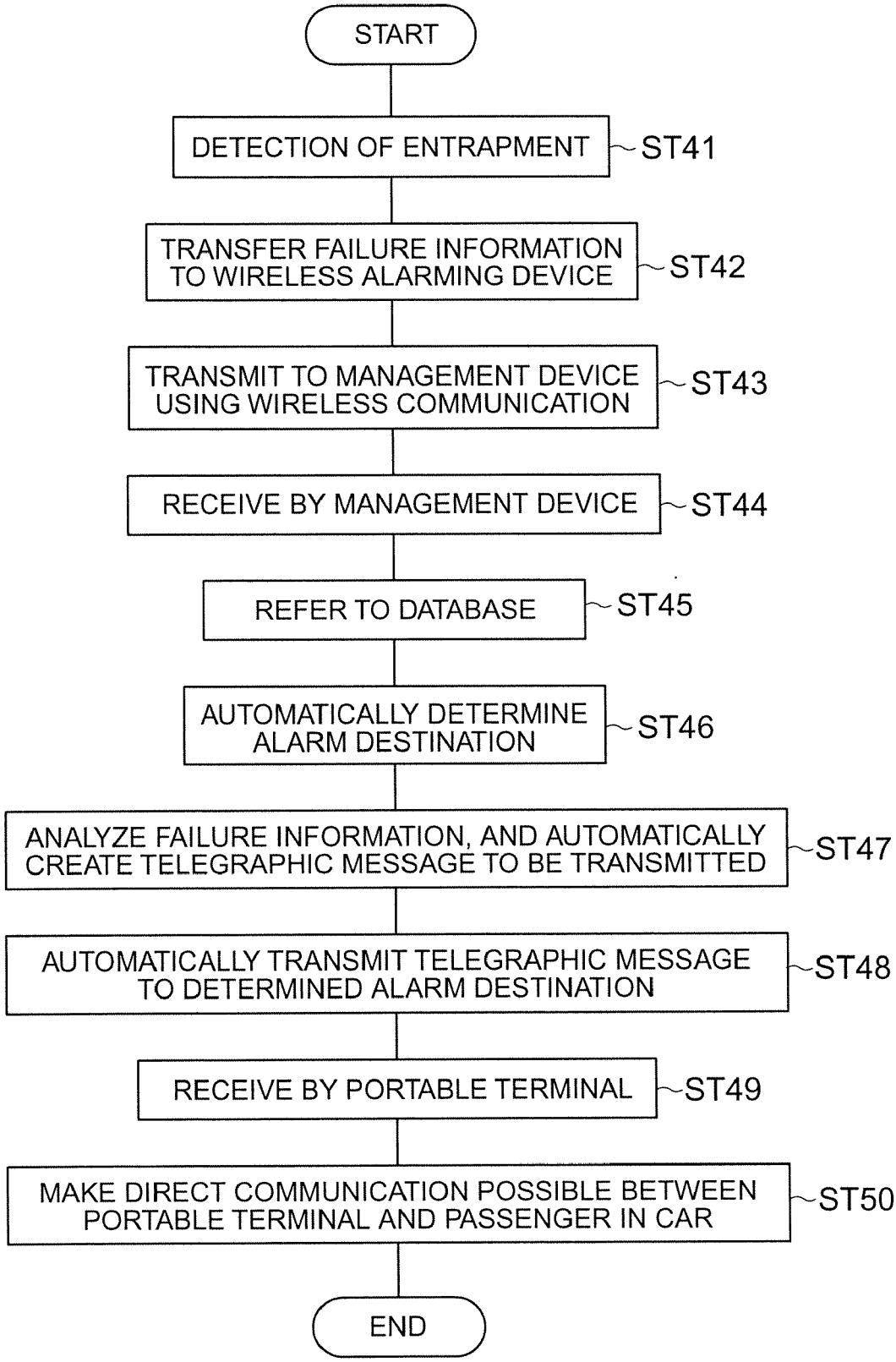
FIG. 4 is a flowchart for explaining detailed operations of the remote alarming system for an elevator according to the embodiment of the present invention.

Next, detailed operations of the remote alarming system for an elevator according to the embodiment of the present invention will be described with reference to the flowchart shown in FIG. 4. When the elevator control device 2 detects entrapment (Step ST41), the elevator control device 2 transfers the failure information to the wireless alarming device 3 (Step ST42). Then, the wireless alarming device 3 transmits the failure information to the management device 4 through the wireless communication (Step ST43), and the failure information is then received by the management device 4 (Step ST44). In addition, the voice notification means 23 in the elevator control device 2 notifies by voice through the speaker 11 of the car 1 the fact that an alarm has been transmitted to the outside at the time of transmitting the failure information from the wireless alarming device 3.

Next, the management device 4 refers to the database 42 (Step ST45), determines the alarm destination (Step ST46), and analyzes the failure information to create the telegraphic message to be transmitted (Step ST47). Then, the management device 4 automatically transmits the telegraphic message to the determined alarm destination (manager of the building or maintenance operator) (Step ST48). It should be noted that a plurality of managers of the building and maintenance operators can be set as the alarm destination, and an alarm may be transmitted based on a predetermined order of priority.

According to the procedure described above, portable terminals 5 held by the managers of the building and the maintenance operators receive the telegraphic message (Step ST49), whereby it is possible to communicate directly with the passenger in the car 1 from the portable terminal 5 which has received the message (Step ST50).

In the above embodiment, an alarm is given by way of telegraphic messages. However, the telegraphic message and the voice can be presented concurrently to the portable terminal 5 held by the manager of the building or the maintenance operator by creating voice data, for example.

As described above, according to the present invention, the remote alarming system can be built by a relatively simple method without a provision of the large-scaled monitor center, and communication can be directly performed from the portable terminal 5 held by the manager of the building or the maintenance operator to the passenger in the car 1 even when the monitoring device fails or the manager is absent.

The invention claimed is:

1. A remote alarming system for an elevator, comprising:

an elevator control device including failure information detecting means for detecting failure information of an elevator;

a wireless alarming device provided independently of the elevator control device, the wireless alarming device for transmitting the failure information of the elevator from the elevator control device through wireless communication;

a management device remotely provided from a building in which the elevator is installed, the management device being capable of performing wireless communication; and a portable terminal performing the wireless communication with the wireless alarming device and the management device via a base station, wherein the management device includes a database in which management information corresponding to each of the elevators is registered in advance, determines an alarm destination based on the management information registered in the database at a time of reception of the failure information, creates a telegraphic message to be transmitted based on contents of the failure information, and transmits the created telegraphic message to the portable terminal which is the determined alarm destination; and the wireless alarming device allows the communication from the portable terminal as the alarm destination to a passenger in a car by connecting to a speaker provided in the car of the elevator.

2. The remote alarming system for an elevator according to claim 1, wherein the elevator control device notifies by voice through the speaker that an alarm has been transmitted to the outside at a time of transmission of the failure information.

* * * * *